US009851648B2

(12) United States Patent
Nishi et al.

(10) Patent No.: US 9,851,648 B2
(45) Date of Patent: Dec. 26, 2017

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Masashi Nishi, Susono (JP); Kunihiko Sekido, Suntou-gun (JP); Michiyo Sekiya, Atami (JP); Kei Tagami, Yokohama (JP); Isao Kawata, Kawasaki (JP); Yuto Ito, Koganei (JP); Akihito Saitoh, Gotemba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/169,418

(22) Filed: May 31, 2016

(65) Prior Publication Data

US 2016/0377999 A1 Dec. 29, 2016

(30) Foreign Application Priority Data

Jun. 25, 2015 (JP) ..... 2015-127981

(51) Int. Cl.
*G03G 5/14* (2006.01)
*G03G 21/18* (2006.01)
*G03G 15/00* (2006.01)

(52) U.S. Cl.
CPC ..... *G03G 5/142* (2013.01); *G03G 15/75* (2013.01); *G03G 21/18* (2013.01)

(58) Field of Classification Search
CPC ..... G03G 5/14; G03G 5/142
See application file for complete search history.

(56) References Cited

U.S. PATENT DOCUMENTS 4,442,193 A 4/1984 Chen et al.
4,992,349 A 2/1991 Chen et al.
(Continued)

FOREIGN PATENT DOCUMENTS

JP 2007-148294 A 6/2007
JP 2008-250082 A 10/2008

OTHER PUBLICATIONS

Szabo, et al., "Modern Quantum Chemistry", University of Tokyo Press, Hartree-Fock, 1991, pp. 116-125.
(Continued)

*Primary Examiner* — Peter Vajda
(74) *Attorney, Agent, or Firm* — Fitzpatrick Cella Harper and Scinto

(57) ABSTRACT

The present invention provides an electrophotographic photosensitive member that allows positive ghost to be reduced even in repeated use. The electrophotographic photosensitive member of the present invention is an electrophotographic photosensitive member wherein an undercoat layer contains a polymerization product of a composition including a compound represented by the following formula (1).

(1)

8 Claims, 2 Drawing Sheets

(56) References Cited

U.S. PATENT DOCUMENTS

| | | | |
|---|---|---|---|
| 5,455,135 | A | 10/1995 | Maruyama et al. |
| 5,468,583 | A | 11/1995 | Gruenbaum et al. |
| 5,604,061 | A | 2/1997 | Sekido et al. |
| 5,693,443 | A | 12/1997 | Nakamura et al. |
| 6,110,628 | A | 8/2000 | Sekiya et al. |
| 6,228,546 | B1 | 5/2001 | Kashizaki et al. |
| 6,372,397 | B1 | 4/2002 | Maruyama et al. |
| 6,436,597 | B2 | 8/2002 | Maruyama et al. |
| 6,664,014 | B1 | 12/2003 | Kikuchi et al. |
| 7,141,341 | B2 | 11/2006 | Sekido et al. |
| 7,378,205 | B2 | 5/2008 | Sekiya et al. |
| 8,343,699 | B2 | 1/2013 | Nagasaka et al. |
| 8,465,889 | B2 | 6/2013 | Sekido et al. |
| 8,524,430 | B2 | 9/2013 | Takagi et al. |
| 8,546,050 | B2 | 10/2013 | Maruyama et al. |
| 8,632,931 | B2 | 1/2014 | Sekido et al. |
| 8,795,936 | B2 | 8/2014 | Sekido et al. |
| 9,029,054 | B2 | 5/2015 | Okuda et al. |
| 9,063,505 | B2 | 6/2015 | Sekiya et al. |
| 9,069,267 | B2 | 6/2015 | Kaku et al. |
| 9,164,406 | B2 | 10/2015 | Nishi et al. |
| 9,207,550 | B2 | 12/2015 | Okuda et al. |
| 9,280,072 | B2 | 3/2016 | Ogaki et al. |
| 9,335,645 | B2 | 5/2016 | Tagami et al. |
| 9,442,401 | B2 | 9/2016 | Sekido et al. |
| 9,477,163 | B2 | 10/2016 | Nishi et al. |
| 2014/0004454 | A1* | 1/2014 | Okuda ..... G03G 5/0605 430/56 |
| 2015/0185630 | A1 | 7/2015 | Ito et al. |
| 2015/0185634 | A1 | 7/2015 | Sekiya et al. |
| 2015/0185636 | A1 | 7/2015 | Sekiya et al. |
| 2015/0185638 | A1 | 7/2015 | Nakamura et al. |
| 2016/0116853 | A1 | 4/2016 | Sekiya et al. |
| 2016/0291489 | A1 | 10/2016 | Sekido et al. |

OTHER PUBLICATIONS

Parr, et al., "Density-Functional Theory of Atoms and Molecules", Springer-Verlag, 1996, pp. 48-55.

Cances, et al., J. Chem. Phys., vol. 107, 1997, 3033-3034.

Yamashita, et al., "Crosslinking Agent Handbook", 1981, pp. 536-543, and pp. 594-605.

Jones, et al., "Cyanonaphthalene Diimide Semiconductors for Air-Stable, Flexible, and Optically Transparent n-Channel Field-Effect Transistors", Chemistry of Materials, vol. 19, No. 11, May 29, 2007, pp. 2703-2705.

* cited by examiner

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

Field of the Invention

The present invention relates to an electrophotographic photosensitive member, and a process cartridge and an electrophotographic apparatus including an electrophotographic photosensitive member.

Description of the Related Art

An electrophotographic photosensitive member containing an organic photoconductive material (charge generation material) is used as an electrophotographic photosensitive member to be mounted on a process cartridge and/or an electrophotographic apparatus. A common electrophotographic photosensitive member includes a support and a photosensitive layer formed on the support, the photosensitive layer containing a charge generation material.

Furthermore, an undercoat layer is often provided between the support and the photosensitive layer for the purpose of suppressing charge injection from the support to the photosensitive layer.

In recent years, charge generation materials having a higher sensitivity have been used. Along with an increase in sensitivity of the charge generation material, however, the amount of a charge to be generated is larger, and therefore the charge is easily retained in the photosensitive layer to easily cause positive ghost to occur. The positive ghost is a phenomenon where the density of only a region irradiated with light in pre-rotation during formation of one sheet of an image is increased.

As a technique for suppression of such positive ghost, Japanese Patent Application Laid-Open No. 2007-148294 and Japanese Patent Application Laid-Open No. 2008-250082 describe a technique in which an electron transport material is contained in an undercoat layer. Japanese Patent Application Laid-Open No. 2007-148294 and Japanese Patent Application Laid-Open No. 2008-250082 also describe a technique in which, when the electron transport material is contained in the undercoat layer, the undercoat layer is cured so as not to, during formation of an upper layer (photosensitive layer) of the undercoat layer, elute the electron transport material into a solvent in a coating liquid for a photosensitive layer.

SUMMARY OF THE INVENTION

In recent years, the quality of an electrophotographic image has been increasingly demanded to be higher, and the positive ghost described above has been extremely hardly acceptable.

The present inventors have made studies and, as a result, have found that the techniques described in Japanese Patent Application Laid-Open No. 2007-148294 and Japanese Patent Application Laid-Open No. 2008-250082 have room for improvement in reduction of positive ghost.

The present invention is directed to providing an electrophotographic photosensitive member that allows positive ghost to be suppressed, and a process cartridge and an electrophotographic apparatus including the electrophotographic photosensitive member.

According to one aspect of the present invention, there is provided an electrophotographic photosensitive member comprising a support and an undercoat layer formed on the support, wherein the undercoat layer contains a polymerization product of a composition including a compound that has a structure represented by the following formula (1) and that has a polarizability per unit volume according to a density functional approach (B3LYP/6-31+G**), of 0.533 or more and 0.594 or less:

(1)

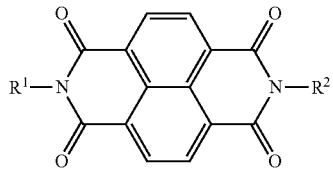

wherein, in the formula (1), $R^1$ and $R^2$ each independently represent a substituted or unsubstituted alkyl group, a group derived by replacing at least one $CH_2$ in a main chain of a substituted or unsubstituted alkyl group with an oxygen atom, a group derived by replacing at least one $CH_2$ in a main chain of a substituted or unsubstituted alkyl group with $NR^3$, a group derived by replacing at least one $C_2H_4$ in a main chain of a substituted or unsubstituted alkyl group with COO, or a substituted or unsubstituted aryl group; $R^3$ represents a hydrogen atom or an alkyl group; and furthermore any one of $R^1$ and $R^2$ represents two or more hydroxy groups or carboxyl groups.

According to another aspect of the present invention, there is provided a process cartridge that integrally supports the electrophotographic photosensitive member, and at least one unit selected from the group consisting of a charging unit, a developing unit, a transfer unit and a cleaning unit, and that is detachable from a main body of an electrophotographic apparatus.

According to further aspect of the present invention, there is provided an electrophotographic apparatus including the electrophotographic photosensitive member, a charging unit, an exposure unit, a developing unit and a transfer unit.

The present invention can provide an electrophotographic photosensitive member that allows positive ghost to be suppressed, and a process cartridge and an electrophotographic apparatus including the electrophotographic photosensitive member.

Further features of the present invention will become apparent from the following description of exemplary embodiments with reference to the attached drawings.

DESCRIPTION OF THE EMBODIMENTS

Figure 1:
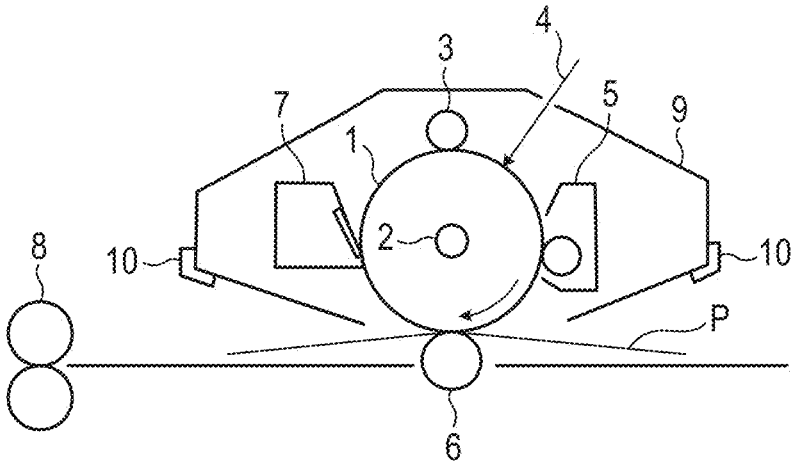
FIG. 1 is a view illustrating a schematic configuration of an electrophotographic apparatus including a process cartridge provided with an electrophotographic photosensitive member.

Preferred embodiments of the present invention will now be described in detail in accordance with the accompanying drawings.

The present invention provides an electrophotographic photosensitive member wherein an undercoat layer contains a polymerization product of a composition including a compound that has a structure represented by the following formula (1) and that has a polarizability per unit volume according to a density functional approach (B3LYP/6-31+G**), of 0.533 or more and 0.594 or less:

(1)

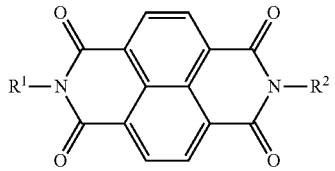

wherein, in the formula (1), $R^1$ and $R^2$ each independently represent a substituted or unsubstituted alkyl group, a group derived by replacing at least one $CH_2$ in a main chain of a substituted or unsubstituted alkyl group with an oxygen atom, a group derived by replacing at least one $CH_2$ in a main chain of a substituted or unsubstituted alkyl group with $NR^3$, a group derived by replacing at least one $C_2H_4$ in a main chain of a substituted or unsubstituted alkyl group with COO, or a substituted or unsubstituted aryl group; $R^3$ represents a hydrogen atom or an alkyl group; and furthermore any one of $R^1$ and $R^2$ represents two or more hydroxy groups or carboxyl groups.

The present inventors presume as follows with respect to the reason why the undercoat layer contains the polymerization product to thereby allow for a reduction in positive ghost.

One cause of the occurrence of positive ghost is considered to be electronic trap due to a farther distance between molecules of an electron transport material and thus less overlapping of electron cloud. If the electronic trap is formed in the undercoat layer, electron transport property is easily deteriorated to easily cause a remaining charge to be generated. Thus, it is considered that the remaining charge is easily accumulated during repeated use for a long period to thereby cause positive ghost to occur.

In the present invention, the compound represented by the formula (1) (electron transport material) has, at any one of $R^1$ and $R^2$, two or more hydroxy groups or carboxyl groups that are hydrogen-bonding substituents. Thus, it is considered that the interaction between such substituents can allow the electron transport material to be closely present. $R^1$ can be a substituted alkyl group having a hydroxy group or a carboxyl group because the interaction of a hydrogen bond is larger. $R^1$ and $R^2$ can be a different structure because the electron transport material is suppressed from being aggregated and is appropriately dispersed as compared with the case where $R^1$ and $R^2$ represent the same structure.

Furthermore, the expansion of electron cloud is also considered to be related to the occurrence of positive ghost. The term "polarizability" means the expansion of electron cloud of a molecule, and an electron transport material having a high polarizability is known to be large in overlapping of electron cloud and have an advantage in electron transfer. A compound having a high polarizability, however, is also larger in the change of charge distribution under application of an electric field, and therefore an electron transport material having a too high polarizability is considered to have a disadvantage in repeated application of a high electric field as in the case of the electrophotographic photosensitive member. It is considered that the intermolecular charge distribution is varied repeatedly to result in deterioration in properties of the electron transport material by itself, aggregation due to the interaction with other electron transport material, and the like, thereby causing an obstructive factor of electron transfer.

The electron transport material represented by the formula (1), which has a polarizability per unit volume according to a density functional approach (B3LYP/6-31+G**), of 0.533 or more and 0.594 or less, is good in electron transfer and hardly causes an obstructive factor of electron transfer due to repeated use, and is thus considered to be reduced in positive ghost.

A polarizability calculation method is roughly classified to a molecular orbital (Molecular Orbital: MO) method and a density functional theory (Density Functional Theory: DFT) method, and the detail is described in Szabo and Ostlund, "Modern Quantum Chemistry," University of Tokyo Press, 1991, and Parr and Yang, "Density-Functional Theory of Atoms and Molecules," Springer-Verlag, 1996.

In the present invention, the calculation is conducted using a density functional approach, specifically, Gaussian 09 manufactured by Gaussian Inc. The functional/basis function is defined as B3LYP/6-31+G**, respectively, and the polarizability Pm per unit molecular volume calculated by the density functional approach is defined by the following expression:

$$P_m=\alpha_0/V$$

wherein $\alpha_0$ represents the static polarizability of a molecule and the unit thereof is designated as the cube of the Bohr radius. $\alpha_0$ represents the ratio of the dipole moment p induced in a molecule placed in an electric field with a frequency of zero to the electric field E, and is defined by the following expression:

$$p=\alpha_0 E$$

wherein V represents the volume of a molecule and the unit thereof is designated as the cube of angstrom. V is calculated by replacing each atom of a molecule for calculation by a sphere having the VanderWaals radius of the atom in the structure of the molecule, and generating the set thereof. Such calculation is conducted by using Gaussian 09 to specify an SCRF option and optimize the molecular structure. In the SCRF option, the molecular structure in a water solvent is identified by calculation using an IEF-PCM model (M. T. Cances, B. Mennucci, and J. Tomasi, J. Chem. Phys. 107, 3033-3034 (1997).). The resulting molecular structure is used for further calculation of $\alpha_0$. The molecular structure used here is one resulting from optimizing of the structure by the calculation.

(Electron Transport Material)

The undercoat layer in the present invention contains a polymerization product of a composition including the compound represented by the formula (1) (electron transport material). The compound represented by the formula (1) is as described above.

When the undercoat layer contains the polymerization product of the composition including the compound represented by the formula (1), the composition can further include a crosslinking agent, or a crosslinking agent and a resin.

In the compound represented by the formula (1), the polarizability per unit volume according to a density functional approach (B3LYP/6-31+G**) can be 0.545 or more and 0.577 or less. When the polarizability is in the range, it is considered that an obstructive factor of electron transfer is more suppressed to more suppress positive ghost.

(Crosslinking Agent)

As the crosslinking agent, a compound that is polymerizable (curable) or crosslinkable with the compound represented by the formula (1) (electron transport material) can be used. Specifically, a compound described in "Crosslinking Agent Handbook" edited by Shinzo Yamashita, Tosuke Kaneko, published by Taiseisha Ltd. (1981) and the like can be used.

Examples of the crosslinking agent include isocyanate compounds and amine compounds shown below, but are not limited thereto in the present invention. The crosslinking agent can also be used in combinations of a plurality thereof.

The isocyanate compound can be an isocyanate compound having a plurality of isocyanate groups or block isocyanate groups. Examples include triisocyanate benzene, triisocyanate methylbenzene, triphenylmethane triisocyanate and lysine triisocyanate; as well as isocyanurate-modified products, biuret-modified products and allophanate-modified products of diisocyanate such as tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl-2,6-diisocyanate hexanoate and norbornane diisocyanate, and adduct-modified products of any of such diisocyanates with trimethylolpropane or pentaerythritol. In particular, isocyanurate-modified products and adduct-modified products are more preferable.

Examples of a commercially available isocyanate compound (crosslinking agent) include isocyanate type crosslinking agents such as Duranate MFK-60B and SBA-70B manufactured by Asahi Kasei Corporation, and Desmodur BL3175 and BL3475 manufactured by Sumika Bayer Urethane Co., Ltd., amine type crosslinking agents such as U-VAN 20SE60 and 220 manufactured by Mitsui Chemicals, Inc., and Super Beckamine L-125-60 and G-821-60 manufactured by DIC Corporation, and acrylic crosslinking agents such as Fancryl FA-129AS FA-731A manufactured by Hitachi Chemical Co., Ltd.

The amine compound can be, for example, an amine compound having a plurality of N-methylol groups or alkyl-etherified N-methylol groups. Examples include methylolated melamine, methylolated guanamine, a methylolated urea derivative, a methylolated ethyleneurea derivative, methylolated glycoluril and such compounds in which a methylol moiety is alkyl-etherified, and derivatives thereof.

Examples of a commercially available amine compound (crosslinking agent) include Super Melamine No. 90 (manufactured by NOF Corporation), Super Beckamine (R) TD-139-60, L-105-60, L127-60, L110-60, J-820-60 and G-821-60 (manufactured by DIC Corporation), U-VAN 2020 (Mitsui Chemicals, Inc.), Sumitex Resin M-3 (Sumitomo Chemical Co., Ltd.), Nikalac MW-30, MW-390 and MX-750LM (manufactured by Nippon Carbide Industries Co., Inc.), Super Beckamine (R)L-148-55, 13-535, L-145-60 and TD-126 (manufactured by DIC Corporation), Nikalac BL-60 and BX-4000 (manufactured by Nippon Carbide Industries Co., Inc.), and Nikalac MX-280, Nikalac MX-270 and Nikalac MX-290 (manufactured by Nippon Carbide Industries Co., Inc.).

(Resin)

As the resin, a resin having a polymerizable functional group that can be polymerized (cured) with the compound represented by the formula (1) can be used. Examples of the polymerizable functional group can include a hydroxy group, a thiol group, an amino group, a carboxyl group or a methoxy group.

Examples of the resin having the polymerizable functional group include a polyether polyol resin, a polyester polyol resin, a polyacrylic polyol resin, a polyvinyl alcohol resin, a polyvinyl acetal resin, a polyamide resin, a carboxyl group-containing resin, a polyamine resin and a polythiol resin, but are not limited thereto in the present invention. The resin may also be used in combinations of a plurality thereof.

Examples of a commercially available resin having the polymerizable functional group include polyether polyol resins such as AQD-457 and AQD-473 manufactured by Nippon Polyurethane Industry Co., Ltd. and Sannix GP-400 and GP-700 manufactured by Sanyo Chemical Industries, Ltd., polyester polyol resins such as Phthalkyd W2343 manufactured by Hitachi Chemical Co., Ltd., Watersol S-118 and CD-520 manufactured by DIC Corporation and Haridip WH-1188 manufactured by Harima Chemicals Inc., polyacrylic polyol resins such as Burnock WE-300, WE-304 manufactured by DIC Corporation, polyvinyl alcohol resins such as Kuraray Poval PVA-203 manufactured by Kuraray Co., Ltd., polyvinyl acetal resins such as BX-1, BM-1, KS-1 and KS-5 manufactured by Sekisui Chemical Co., Ltd., polyamide resins such as Toresin FS-350 manufactured by Nagase Chemtex Corporation, carboxyl group-containing resins such as Aqualic manufactured by Nippon Shokubai Co., Ltd. and Finelex SG2000 manufactured by Namariichi Co., Ltd., polyamine resins such as Luckamide manufactured by DIC Corporation, and polythiol resins such as QE-340M manufactured by Toray Industries Inc.

The weight average molecular weight of the resin having the polymerizable functional group is preferably in the range from 5,000 to 400,000, more preferably in the range from 5,000 to 300,000.

The ratio of the compound represented by the formula (1) to other component in the composition can be 100:50 to 100:250 from the viewpoint of suppression of positive ghost.

That is, the ratio of the mass of the compound represented by the formula (1) to the mass of the crosslinking agent and/or the resin having the polymerizable functional group can be 100:50 to 100:250.

The undercoat layer may contain, in addition to the polymerization product, other resin (resin having no polymerizable functional group), an organic particle, an inorganic particle, a leveling agent and the like in order to enhance film formability and electrical properties. The content of such component(s) in the undercoat layer, however, is preferably 50% by mass or less, more preferably 20% by mass or less based on the total mass of the undercoat layer.

The undercoat layer can be formed by forming a coating film of a coating liquid for an undercoat layer, the liquid containing the compound represented by the formula (1) (electron transport material) or the composition including the compound represented by the formula (1), and drying the coating film. The compound represented by the formula (1) is polymerized during drying of the coating film of the coating liquid for an undercoat layer, and such a polymerization reaction (curing reaction) is here promoted by application of heat and/or light energy.

The solvent for use in the coating liquid for an undercoat layer includes an alcohol solvent, a sulfoxide solvent, a ketone solvent, an ether solvent, an ester solvent or an aromatic hydrocarbon solvent.

The thickness of the undercoat layer is preferably 0.2 μm or more and 3.0 μm or less, more preferably 0.4 μm or more and 1.5 μm or less.

Hereinafter, specific examples of the electron transport material are shown below, but are not limited thereto in the present invention. The electron transport material may be used in combinations of a plurality thereof.
TABLE 1
| Exemplary compound | Structure | Polarizability per unit volume |
|---|---|---|
| 1-1 | 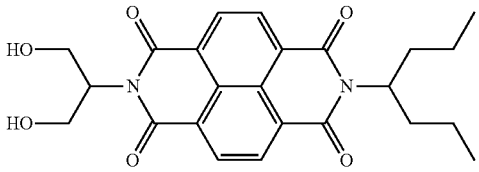 | 0.573 |
| 1-2 | 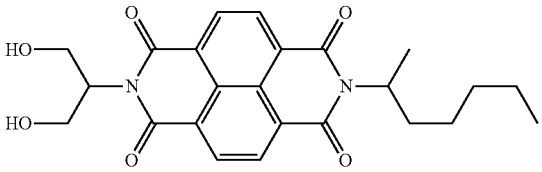 | 0.566 |
| 1-3 | 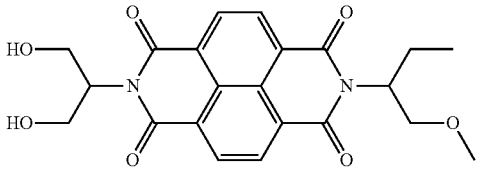 | 0.575 |
| 1-4 | 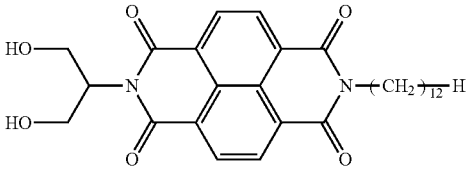 | 0.555 |
| 1-5 | 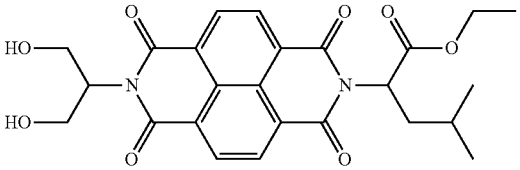 | 0.565 |
| 1-6 | 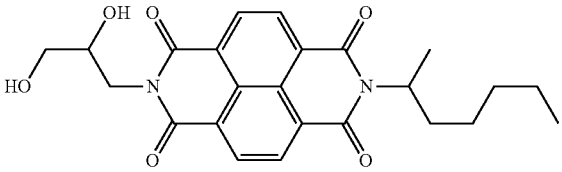 | 0.563 |
| 1-7 | 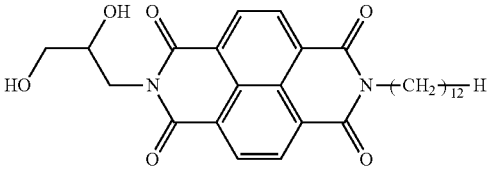 | 0.554 |
| 1-8 | 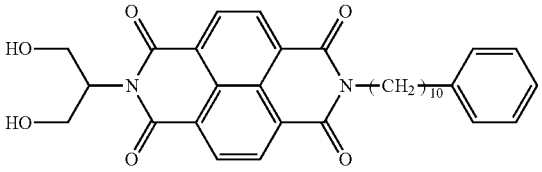 | 0.577 |

TABLE 1-continued
| Exemplary compound | Structure | Polarizability per unit volume |
|---|---|---|
| 1-9 | 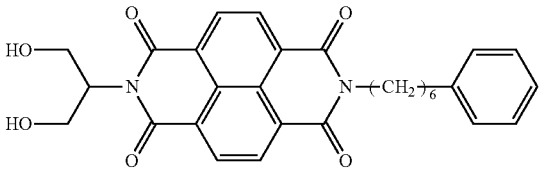 | 0.589 |
| 1-10 | 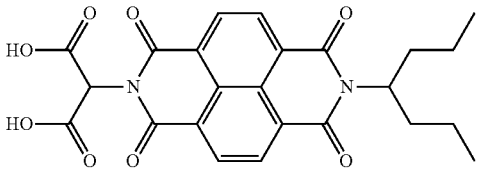 | 0.575 |
| 1-11 | 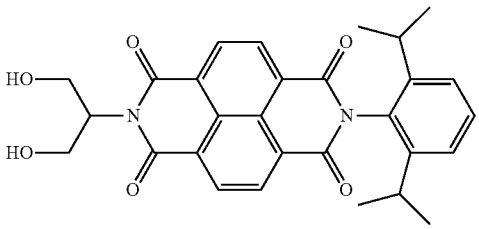 | 0.592 |
| 1-12 | 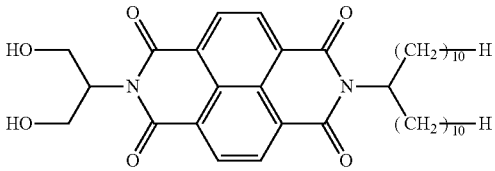 | 0.533 |
| 1-13 | 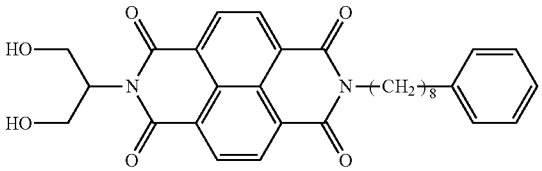 | 0.584 |
| 1-14 | 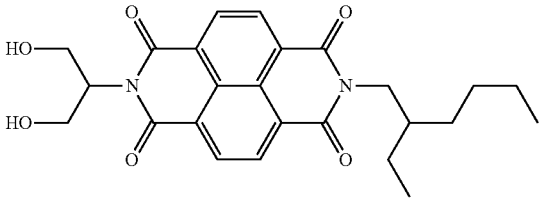 | 0.569 |
| 1-15 | 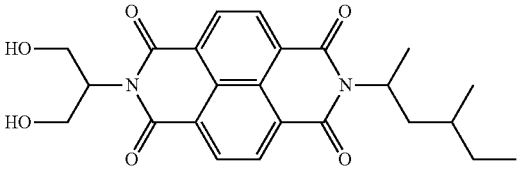 | 0.574 |
| 1-16 | 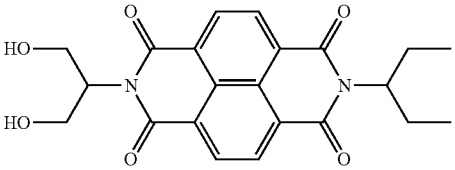 | 0.583 |

TABLE 1-continued
| Exemplary compound | Structure | Polarizability per unit volume |
|---|---|---|
| 1-17 | 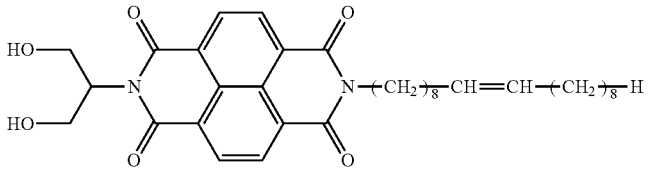 | 0.550 |
| 1-18 | 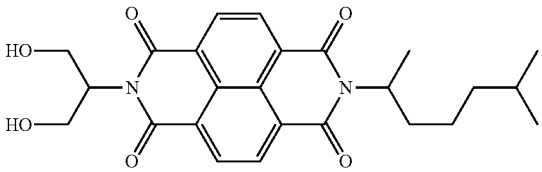 | 0.571 |
| 1-19 | 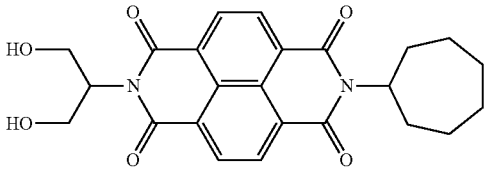 | 0.594 |
| 1-20 | 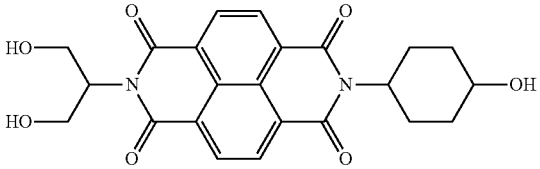 | 0.586 |
| 1-21 | 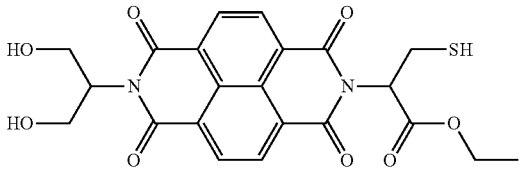 | 0.574 |
| 1-22 | 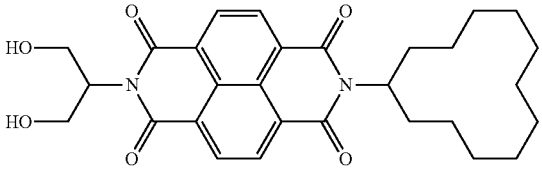 | 0.576 |
| 1-23 | 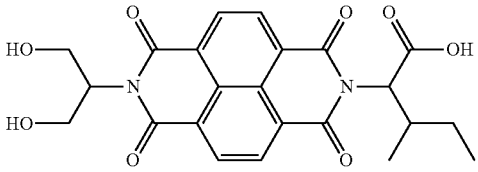 | 0.577 |
| 1-24 | 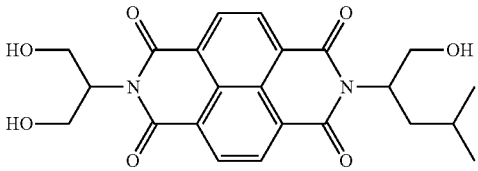 | 0.575 |

TABLE 1-continued

| Exemplary compound | Structure | Polarizability per unit volume |
|---|---|---|
| 1-25 | 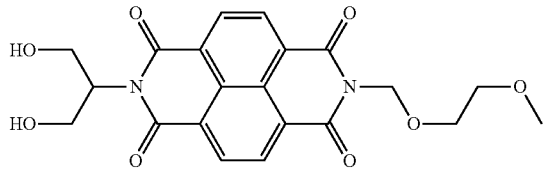 | 0.573 |
| 1-26 | 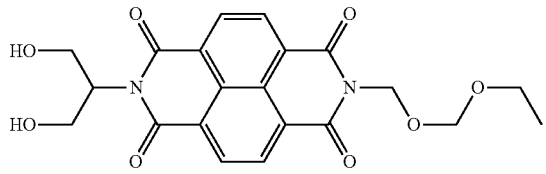 | 0.577 |
| 1-27 | 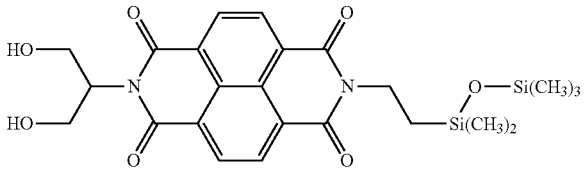 | 0.561 |
| 1-28 | 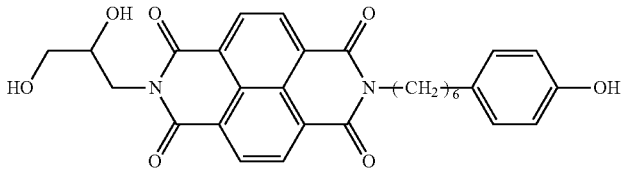 | 0.590 |
| 1-29 | 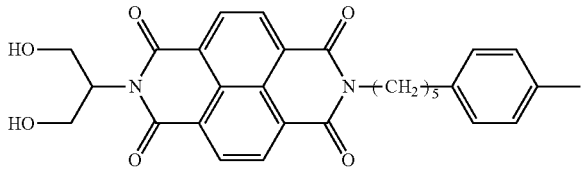 | 0.591 |
| 1-30 | 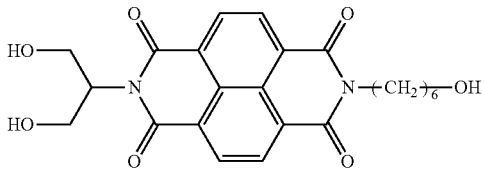 | 0.566 |

The derivative having the structure of the formula (1) (electron transport material derivative) can be synthesized by a known synthesis method described in, for example, U.S. Pat. No. 4,442,193, U.S. Pat. No. 4,992,349, U.S. Pat. No. 5,468,583, and Chemistry of materials, Vol. 19, No. 11,2703-2705 (2007). The derivative can also be synthesized by a reaction of naphthalenetetracarboxylic dianhydride with a monoamine derivative, which are commercially available from Tokyo Chemical Industry Co., Ltd., Sigma-Aldrich Japan K. K. and Johnson Matthey Japan Incorporated.

The compound represented by the formula (1) has a polymerizable functional group (hydroxy group or carboxyl group) that can react with the crosslinking agent. The method for introducing such a polymerizable functional group into the derivative having the structure of the formula (1) includes a method for directly introducing such a polymerizable functional group into the derivative having the structure of the formula (1), and a method for introducing such a polymerizable functional group or a structure having a functional group that can serve as a precursor of the polymerizable functional group. Examples of the latter method include a method for introducing a functional group-containing aryl group by a cross-coupling reaction of a halide of a naphthylimide derivative with a palladium catalyst and a base. Examples include a method for introducing a functional group-containing alkyl group by a cross-coupling reaction of a halide of a naphthylimide derivative with a $FeCl_3$ catalyst and a base. Examples also include a method for introducing a hydroxyalkyl group and a carboxyl group by lithiating a halide of a naphthylimide derivative and then allowing an epoxy compound or $CO_2$ to act on the halide. The naphthylimide derivative can be synthesized using, as a raw material, a naphthalenetetracarboxylic dianhydride derivative or a monoamine derivative having the polymerizable functional group or a functional group that can serve as a precursor of the polymerizable functional group.

The electrophotographic photosensitive member of the present invention is an electrophotographic photosensitive member including a support, an undercoat layer formed on the support, and a photosensitive layer formed on the undercoat layer. The electrophotographic photosensitive member can be a lamination type (function separation type) photosensitive layer in which a charge generation layer containing a charge generation material and a charge transport layer containing a charge transport material are separated. The lamination type photosensitive layer can be a sequential lamination type photosensitive layer in which the charge generation layer and the charge transport layer are sequentially laminated in such an order from the support in terms of electrophotographic properties.

Figure 4A:
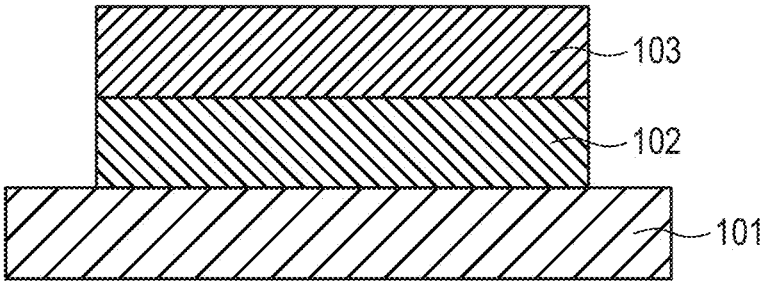
FIG. 4A is a view illustrating one example of a layer configuration of an electrophotographic photosensitive member.
Figure 4B:
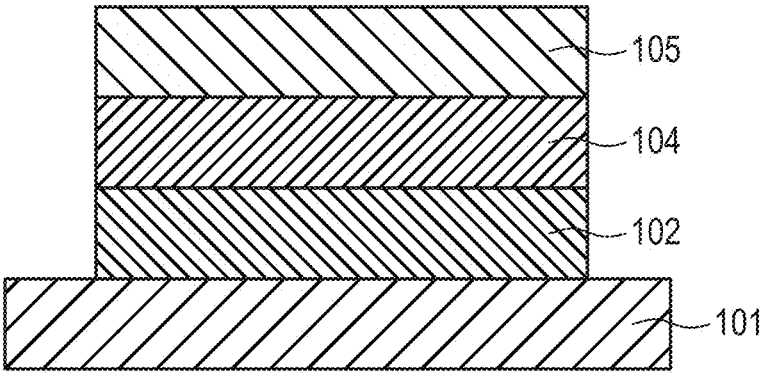
FIG. 4B is a view illustrating one example of a layer configuration of an electrophotographic photosensitive member.

FIGS. 4A and 4B are each a view for illustrating one example of a layer configuration of the electrophotographic photosensitive member. In FIG. 4A, a support 101, an undercoat layer 102 formed on the support 101, and a photosensitive layer 103 formed on the undercoat layer 102 are illustrated. In FIG. 4B, a charge generation layer 104 formed on the undercoat layer and a charge transport layer 105 formed on the charge generation layer are illustrated.

While a common electrophotographic photosensitive member widely used is a cylindrical electrophotographic photosensitive member including a photosensitive layer (charge generation layer, charge transport layer) formed on a cylindrical support, the shape thereof can also be a belt shape, a sheet shape or the like.

(Support)

The support can be a support having conductivity (conductive support). For example, a support made of a metal such as aluminum, nickel, copper, gold or iron, or an alloy thereof can be used. Examples include a support in which a thin film of a metal such as aluminum, silver or gold is formed on an insulating support such as a polyester resin, a polycarbonate resin, a polyimide resin or glass. Examples also include a support on which a thin film of a conductive material such as indium oxide or tin oxide is formed.

The surface of the support may be subjected to an electrochemical treatment such as anodizing, or a wet horning treatment, a blasting treatment or a cutting treatment in order to improve electrical properties and suppress interference fringes.

A conductive layer may be provided between the support and the undercoat layer described later. The conductive layer is obtained by forming a coating film of a coating liquid for a conductive layer, in which a conductive particle is dispersed in a resin, on the support, and drying the coating film.

Examples of the conductive particle include carbon black, acetylene black, metal powders such as aluminum, nickel, iron, nichrome, copper, zinc and silver powders, and metal oxide powders such as conductive tin oxide and ITO powders.

Examples of the resin include a polyester resin, a polycarbonate resin, a polyvinyl butyral resin, an acrylic resin, a silicone resin, an epoxy resin, a melamine resin, a urethane resin, a phenolic resin and an alkyd resin.

Examples of the solvent of the coating liquid for a conductive layer include an ether solvent, an alcohol solvent, a ketone solvent and an aromatic hydrocarbon solvent. The thickness of the conductive layer is preferably 0.2 μm or more and 40 μm or less, more preferably 1 μm or more and 35 μm or less, further preferably 5 μm or more and 30 μm or less.

(Photosensitive Layer)

The photosensitive layer (charge generation layer, charge transport layer) is provided on the undercoat layer. Each of the charge generation layer and the charge transport layer may also be provided as a plurality of layers.

Examples of the charge generation material include an azo pigment, a perylene pigment, an anthraquinone derivative, an anthanthrone derivative, a dibenzpyrenequinone derivative, a pyranthrone derivative, a quinone pigment, an indigoid pigment, a phthalocyanine pigment and a perinone pigment. In particular, an azo pigment and a phthalocyanine pigment can be adopted. As the phthalocyanine pigment, oxytitanium phthalocyanine, chlorogallium phthalocyanine and hydroxygallium phthalocyanine can be adopted.

When the photosensitive layer is the lamination type photosensitive layer, examples of the binder resin for use in the charge generation layer include polymers and copolymers of vinyl compounds such as styrene, vinyl acetate, vinyl chloride, acrylate, methacrylate, vinylidene fluoride and trifluoroethylene, and polyvinyl alcohol, polyvinyl acetal, polycarbonate, polyester, polysulfone, polyphenylene oxide, polyurethane, a cellulose resin, a phenolic resin, a melamine resin, a silicon resin and an epoxy resin. In particular, polyester, polycarbonate and polyvinyl acetal can be adopted.

In the charge generation layer, the ratio of the charge generation material to the binder resin (charge generation material/binder resin) is preferably in the range from 10/1 to 1/10, more preferably in the range from 5/1 to 1/5. The solvent for use in a coating liquid for a charge generation layer includes an alcohol solvent, a ketone solvent, an ether solvent, an ester solvent or an aromatic hydrocarbon solvent. The thickness of the charge generation layer can be 0.05 μm or more and 5 μm or less.

Examples of the charge transport material include a hydrazone compound, a styryl compound, a benzidine compound, a butadiene compound, an enamine compound, a triarylamine compound and triphenylamine. Examples also include a polymer having a group derived from such a compound in the main chain or a side chain.

Examples of the binder resin for use in the charge transport layer include polyester, polycarbonate, polymethacrylate, polyarylate, polysulfone and polystyrene. In particular, polycarbonate and polyarylate can be adopted. The weight average molecular weight (Mw) of such a binder resin can be in the range from 10,000 to 300,000. The ratio of the charge transport material to the binder resin (charge transport material/binder resin) in the charge transport layer is preferably in the range from 10/5 to 5/10, more preferably in the range from 10/8 to 6/10. The thickness of the charge transport layer can be 5 μm or more and 40 μm or less. The solvent for use in the coating liquid for a charge transport layer includes an alcohol solvent, a ketone solvent, an ether solvent, an ester solvent or an aromatic hydrocarbon solvent.

A conductive layer in which a conductive particle such as a metal oxide particle or carbon black is dispersed in a binder resin, or another layer as a second undercoat layer not containing the polymerization product of the present invention may also be provided between the support and the undercoat layer and/or between the undercoat layer and the photosensitive layer.

A protective layer containing a conductive particle, or a charge transport material and a binder resin may also be provided on the photosensitive layer (charge transport layer). The protective layer may further contain an additive such as a lubricant. The binder resin by itself in the protective layer may also have conductivity and charge transport properties, and in such a case, the protective layer may contain no conductive particle and no charge transport material, in addition to the binder resin. The binder resin in the protective layer may be a thermoplastic resin, or may be a curable resin that can be cured by heat, light or radiation (electron beam or the like).

The method for forming each of the undercoat layer, the charge generation layer, the charge transport layer and the like that constitute the electrophotographic photosensitive member can be the following method, namely, a method for forming each of the layers by coating of a coating liquid obtained by dissolving and/or dispersing a material that constitutes each of the layers in a solvent, and drying and/or curing of the resulting coating film. Examples of the coating method of the coating liquid include a dip coating method, a spray coating method, a curtain coating method and a spin coating method. In particular, a dip coating method can be adopted in terms of efficiency and productivity.

(Process Cartridge and Electrophotographic Apparatus)

FIG. 1 illustrates a schematic configuration of an electrophotographic apparatus including a process cartridge provided with an electrophotographic photosensitive member.

In FIG. 1, a cylindrical electrophotographic photosensitive member 1 is rotated and driven around a shift 2 at a predetermined peripheral velocity in the arrow direction. The surface (periphery) of the electrophotographic photosensitive member 1 to be rotated and driven is charged at a predetermined positive or negative potential by a charging unit 3 (for example, a contact type primary charging device and a non-contact type primary charging device). Next, the surface is exposed by exposure light (image exposure light) 4 from an exposure unit (not illustrated) such as a slit exposure or laser beam scanning exposure unit. An electrostatic latent image corresponding to an intended image is thus sequentially formed on the surface of the electrophotographic photosensitive member 1.

The electrostatic latent image formed on the surface of the electrophotographic photosensitive member 1 is then developed by a toner included in a developer in a developing unit 5, and formed into a toner image. The toner image formed and carried on the surface of the electrophotographic photosensitive member 1 is sequentially transferred to a transfer material (paper or the like) P by a transfer bias from a transfer unit (transfer roller or the like) 6. The transfer material P is herein fed from a transfer material feeding unit (not illustrated) to a portion (abutting portion) between the electrophotographic photosensitive member 1 and the transfer unit 6 in synchronization with the rotation of the electrophotographic photosensitive member 1.

The transfer material P to which the toner image is transferred is detached from the surface of the electrophotographic photosensitive member 1, introduced to a fixing unit 8 and subjected to image fixation, and thus taken out as an image forming product (print, copy) outside an apparatus.

The surface of the electrophotographic photosensitive member 1, to which the toner image is transferred, is subjected to removal of a transfer residual developer (transfer residual toner) by a cleaning unit (cleaning blade or the like) 7 for cleaning. Next, the surface is subjected to a neutralization treatment by pre-exposure light (not illustrated) from a pre-exposure unit (not illustrated), and thereafter repeatedly used for image formation. When the charging unit 3 is a contact charging unit using a charging roller as illustrated in FIG. 1, pre-exposure is not necessarily required.

A plurality of components may be selected from the electrophotographic photosensitive member 1, the charging unit 3, the developing unit 5, the transfer unit 6 and the cleaning unit 7, and accommodated in a container and integrally connected to provide a process cartridge. The process cartridge may be configured to be detachable from the main body of an electrophotographic apparatus. In FIG. 1, a cartridge is formed so as to integrally support the electrophotographic photosensitive member 1, and the charging unit 3, the developing unit 5 and the cleaning unit 7, and a guiding unit 10 such as a rail for the main body of an electrophotographic apparatus is used to thereby provide a process cartridge 9 that is detachable from the main body of an electrophotographic apparatus.

EXAMPLES

Hereinafter, the present invention is described with reference to Examples in more detail. Herein, "part(s)" in Examples means "part(s) by mass." First, Synthesis Examples of the compound represented by the formula (1) (electron transport material) are shown.

Synthesis Example 1

Under a nitrogen atmosphere, 5.4 parts of naphthalenetetracarboxylic dianhydride, 4 parts of 4-heptylamine and 3 parts of 2-amino-1,3-propanediol were added to 200 parts of dimethylacetamide, and stirred at room temperature for 1 hour to prepare a solution. The solution was refluxed for 8 hours after preparation, and separated by silica gel column chromatography (developing solvent: ethyl acetate/toluene), and thereafter a fraction containing an intended product is concentrated. The concentrate is subjected to recrystallization by an ethyl acetate/toluene mixed solution to provide 2.0 parts of exemplary compound (1-1).

Synthesis Example 2

Under a nitrogen atmosphere, 5.4 parts of naphthalenetetracarboxylic dianhydride, 4 parts of 2,6-diisopropylaniline and 3 parts of 2-amino-1,3-propanediol were added to 200 parts of dimethylacetamide, and stirred at room temperature for 1 hour to prepare a solution. The solution was refluxed for 10 hours after preparation, and separated by silica gel column chromatography (developing solvent: ethyl acetate/toluene), and thereafter a fraction containing an intended product is concentrated. The concentrate is subjected to recrystallization by an ethyl acetate/toluene mixed solution to provide 1.5 parts of exemplary compound (1-11).

Next, production and evaluation of an electrophotographic photosensitive member are shown.

Example 1

An aluminum cylinder (JIS-A3003, aluminum alloy) having a length of 260.5 mm and a diameter of 30 mm was used as a support (conductive support).

Next, 214 parts of a titanium oxide ($TiO_2$) particle covered with oxygen deficient tin oxide ($SnO_2$), as a metal oxide particle, 132 parts of a phenolic resin (trade name: Plyophen J-325, manufactured by DIC Corporation, resin solid content: 60% by mass) and 98 parts of 1-methoxy-2-propanol were placed in a sand mill using 450 parts of glass beads having a diameter of 0.8 mm, and subjected to a dispersion treatment under conditions of a number of rotations of 2000 rpm, a dispersion treatment time of 4.5 hours and a set temperature of cooling water of 18° C. to prepare a dispersion liquid. The glass beads were removed from the dispersion liquid by use of a mesh (aperture: 150 μm).

A silicone resin particle was added to the dispersion liquid so that the amount thereof was 10% by mass based on the total mass of the metal oxide particle and the binder resin in the dispersion liquid from which the glass beads were removed. A silicone oil was also added to the dispersion liquid so that the amount thereof was 0.01% by mass based on the total mass of the metal oxide particle and the binder resin in the dispersion liquid, and the resultant was stirred to thereby prepare a coating liquid for a conductive layer. The support was dip coated with the coating liquid for a conductive layer to form a coating film, and the resulting coating film was dried and thermally cured at 150° C. for 30 minutes to thereby form a conductive layer having a thickness of 30 μm. As the silicone resin particle, Tospearl 120 (average particle size: 2 μm) manufactured by Momentive Performance Materials Inc. was used. As the silicone oil, SH28PA manufactured by Dow Corning Toray Co., Ltd. was used.

Next, 4 parts of exemplary compound (1-1) synthesized in Synthesis Example 1 and represented by the following formula, 6 parts of a blocked isocyanate compound (trade name: SBN-70D, manufactured by Asahi Kasei Chemicals Corporation), 1.5 parts of a polyvinyl acetal resin (trade name: KS-5Z, manufactured by Sekisui Chemical Co., Ltd.) and 0.015 parts of zinc (II) hexanoate (trade name: zinc (II) hexanoate, manufactured by Mitsuwa Chemicals Co., Ltd.) were dissolved in a mixed solvent of 100 parts of 1-methoxy-2-propanol and 100 parts of tetrahydrofuran.

The support was dip coated with the resulting coating liquid for an undercoat layer, and the resulting coating film was heated and cured (polymerized) at 160° C. for 40 minutes to thereby form an undercoat layer having a thickness of 0.7 μm. The compositional ratio of the undercoat layer is as follows: electron transport material/crosslinking agent/resin=100/150/3.75.

(1-1)

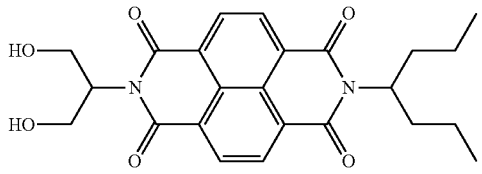

Next, a hydroxygallium phthalocyanine crystal (charge generation material) of a crystal form having strong peaks at Bragg angles (2θ±0.2°) of 7.5°, 9.9°, 12.5°, 16.3°, 18.6°, 25.1° and 28.3° in CuKα characteristic X-ray diffraction was prepared. Ten parts of the hydroxygallium phthalocyanine crystal, 5 parts of a polyvinyl butyral resin (trade name: S-LEC BX-1, manufactured by Sekisui Chemical Co., Ltd.) and 250 parts of cyclohexanone were placed in a sand mill using glass beads having a diameter of 1 mm, and subjected to a dispersion treatment for 2 hours. Next, 250 parts of ethyl acetate was added thereto to thereby prepare a coating liquid for a charge generation layer. The undercoat layer was dip coated with the coating liquid for a charge generation layer to form a coating film, and the resulting coating film was dried at 95° C. for 10 minutes to thereby form a charge generation layer having a thickness of 0.15 μm.

Next, 8 parts of an amine compound (charge transport material) represented by the following formula (4) and 10 parts of a polyarylate resin having a structural unit represented by the following formula (5) were dissolved in a mixed solvent of 40 parts of dimethoxymethane and 60 parts of chlorobenzene to prepare a coating liquid for a charge transport layer. The weight average molecular weight (Mw) of the polyarylate resin was 100000. The charge generation layer was dip coated with the coating liquid for a charge transport layer to form a coating film, and the resulting coating film was dried at 120° C. for 40 minutes to thereby form a charge transport layer having a thickness of 15 μm.

(4)

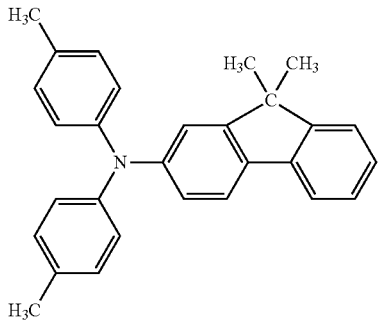

(5)

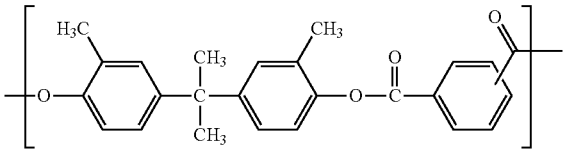

Thus, an electrophotographic photosensitive member including the conductive layer, the undercoat layer, the charge generation layer and the charge transport layer provided on the support was produced.

The electrophotographic photosensitive member produced was installed in a modified machine of a laser beam printer (trade name: LBP-2510) manufactured by Canon Inc. under an environment of a temperature of 23° C. and a humidity of 50% RH, and the surface potential was measured and the output image was evaluated. The printer was modified as follows: the primary charging was roller contact DC charging and the process speed was changed to 120 mm/sec to perform laser exposure. The detail is as follows.

(Evaluation of Potential Variation and Positive Ghost)

An electrophotographic photosensitive member for evaluation of potential variation and positive ghost was installed in an apparatus of a laser beam printer (trade name: LBP-2510) manufactured by Canon Inc., and the following process conditions were set. The surface potential (potential variation) was then evaluated. The printer was modified as follows: the process speed was changed to 200 mm/s, the dark portion potential was −700 V, and the amount of exposure light (image exposure light) was variable. The detail is as follows.

1. Initial Evaluation

A process cartridge for a cyan color of the laser beam printer was modified as follows under an environment of a temperature of 23° C. and a humidity of 50% RH. A potential probe (model 6000B-8: manufactured by Trek Japan) was installed at a development position, and the electrophotographic photosensitive member for evaluation of potential variation and positive ghost was installed. Furthermore, the potential at the center of the electrophotographic photosensitive member was measured using a surface potential meter (model 344: manufactured by Trek Japan), and the amount of exposure light was set so that the dark portion potential (Vd) was −700 V and the light portion potential (Vl) was −200 V with respect to the surface potential of the electrophotographic photosensitive member.

Next, the electrophotographic photosensitive member was installed in the process cartridge for a cyan color of the laser beam printer, and the process cartridge was installed on a process cartridge station for cyan to output an image. First, 1 sheet of a solid white image, 5 sheets of images for ghost evaluation, 1 sheet of a solid black image and 5 sheets of images for ghost evaluation were continuously output in such an order.

Figure 2:
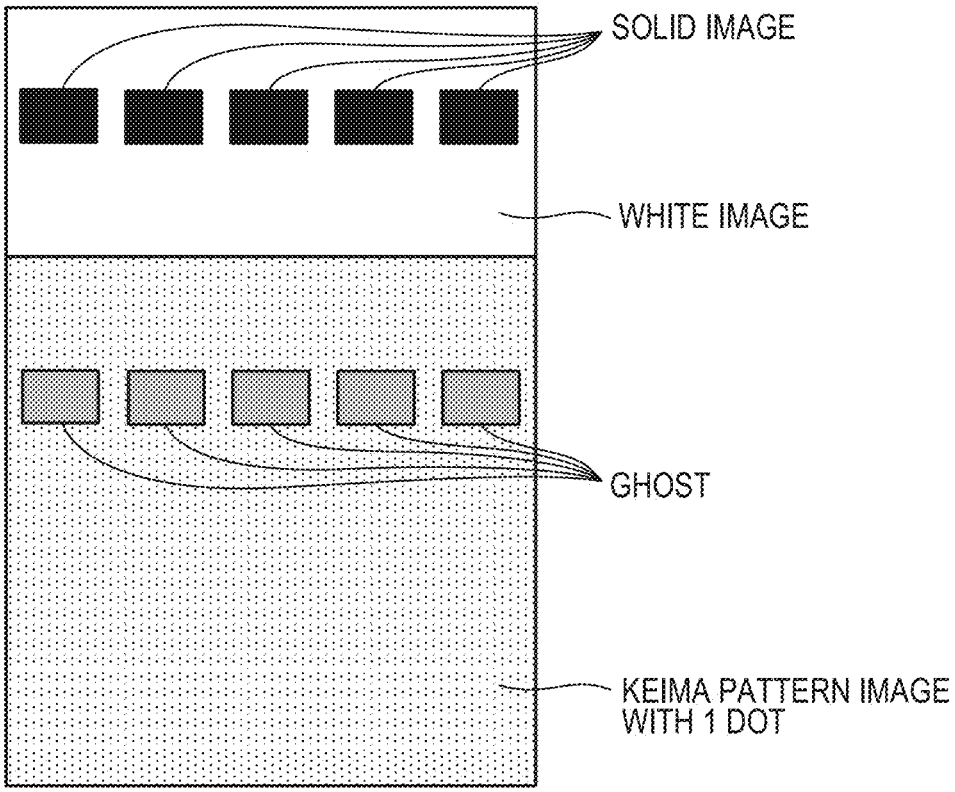
FIG. 2 is a view describing printing for ghost evaluation, to be used in ghost image evaluation.
Figure 3:
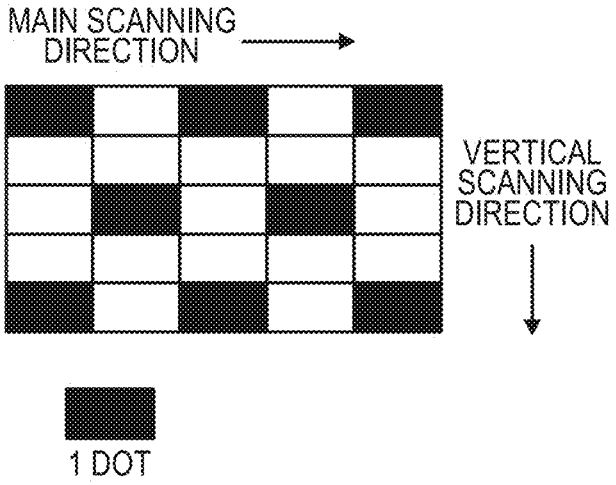
FIG. 3 is a view describing an image of a keima pattern with 1 dot.

Each image for ghost evaluation was an image obtained by outputting a tetragonal "solid image" in a "white image" on the head of the image, as illustrated in FIG. 2, and thereafter forming a "halftone image of a keima pattern with 1 dot" as illustrated in FIG. 3. In FIG. 2, a "ghost" region was a region in which ghost could occur due to a "solid image."

Evaluation of positive ghost was performed by measuring the density difference between the image density of the halftone image of a keima pattern with 1 dot and the image density of the ghost region. The density difference was measured at 10 points in 1 sheet of an image for ghost evaluation by use of a spectroscopic densitometer (trade name: X-Rite 504/508, manufactured by X-Rite Inc.). Such an operation was performed for all 10 sheets of images for ghost evaluation, and the average of 100 points in total was calculated. The results are shown in Table 2. As the density of the ghost region was higher, positive ghost more strongly occurred. It was meant that as the Macbeth density difference was smaller, positive ghost was more suppressed. A density difference of the ghost image (Macbeth density difference) of 0.05 or more corresponded to a level where a clear difference was visually observed, and a density difference of less than 0.05 corresponded to a level where a clear difference was not visually observed.

2. Durability Evaluation

The process cartridge for a cyan color of the laser beam printer was modified as follows under environments of a temperature of 23° C. and a humidity of 50% RH. A potential probe (model 6000B-8: manufactured by Trek Japan) was installed at a development position, and the electrophotographic photosensitive member for evaluation of potential variation and positive ghost was installed. Furthermore, the potential at the center of the electrophotographic photosensitive member was measured using a surface potential meter (model 344: manufactured by Trek Japan), and the amount of exposure light was set so that the dark portion potential (Vd) was −700 V and the light portion potential (Vl) was −200 V with respect to the surface potential of the electrophotographic photosensitive member.

The electrophotographic photosensitive member was repeatedly used for continuous 2000 sheets and 8000 sheets in the state (the state where the potential probe was located on a portion of a developing machine) in the above amount of exposure light. The Vd and the Vl after repeated use for continuous 2000 sheets and 8000 sheets are shown in Table 2. Next, the above electrophotographic photosensitive member after use was installed in an unmodified process cartridge for a cyan color of the laser beam printer, and the process cartridge was installed on a process cartridge station for cyan to output an image (continuously output one sheet of a solid white image, five sheets of images for ghost evaluation, one sheet of a solid black image and five sheets of images for ghost evaluation in such an order). The evaluation results of positive ghost are shown in Table 2.

Examples 2 to 23

Each electrophotographic photosensitive member was produced in the same manner as in Example 1 except that the types and the contents of the compound represented by the formula (1) (electron transport material), the crosslinking agent and the resin having a polymerizable functional group to be mixed in the coating liquid for an undercoat layer were changed as shown in Table 2, and the electrophotographic photosensitive member was evaluated in the same manner. The results are shown in Table 2.

Comparative Example 1

An electrophotographic photosensitive member was produced in the same manner as in Example 1 except that the following coating liquid for an undercoat layer was used, and the electrophotographic photosensitive member was evaluated in the same manner. The results are shown in Table 3.

Five parts of a compound represented by the following formula (7) (polarizability per unit volume: 0.596) and 5 parts of polyamide resin (Amilan CM8000, manufactured by Toray Industries Inc.) were dissolved in a mixed solvent of 120 parts of butanol, 100 parts of methanol and 30 parts of DMF to prepare a coating liquid for an undercoat layer.

(7)

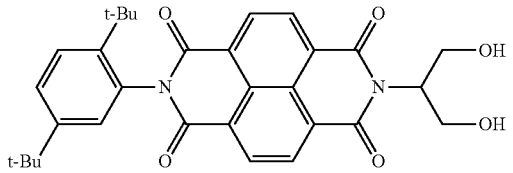

Comparative Example 2

An electrophotographic photosensitive member was produced in the same manner as in Example 1 except that the following coating liquid for an undercoat layer was used, and the electrophotographic photosensitive member was evaluated in the same manner. The results are shown in Table 3.

Ten parts of a compound represented by the following formula (8) (polarizability per unit volume: 0.609) and 5 parts of a phenolic resin (PL-4804, manufactured by Gunei Chemical Industry Co., Ltd.) were dissolved in a mixed solvent of 200 parts of dimethylformamide and 150 parts of benzyl alcohol to prepare a coating liquid for an undercoat layer.

(8)

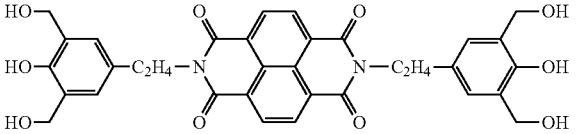

Comparative Example 3

An electrophotographic photosensitive member was produced in the same manner as in Example 1 except that the following coating liquid for an undercoat layer was used, and the electrophotographic photosensitive member was evaluated in the same manner. The results are shown in Table 3.

Ten parts of a compound represented by the following formula (9) (polarizability per unit volume: 0.568), 0.15 parts of zinc (II) octylate and 3 parts of a polyvinyl acetal resin (trade name: KS-5Z, manufactured by Sekisui Chemical Co., Ltd.) were dissolved in a mixed solvent of 250 parts of 1-methoxy-2-propanol and 250 parts of tetrahydrofuran to prepare a coating liquid for an undercoat layer.

Comparative Example 4

An electrophotographic photosensitive member was produced in the same manner as in Example 1 except that the following coating liquid for an undercoat layer was used, and the electrophotographic photosensitive member was evaluated in the same manner. The results are shown in Table 3.

Four parts of a compound represented by the following formula (10) (polarizability per unit volume: 0.596), 0.08 parts of zinc (II) hexanoate and 0.54 parts of a polyvinyl acetal resin (trade name: KS-5Z, manufactured by Sekisui Chemical Co., Ltd.) were dissolved in a mixed solvent of 60 parts of dimethylacetamide and 60 parts of methyl ethyl ketone to prepare a coating liquid for an undercoat layer.

(9)

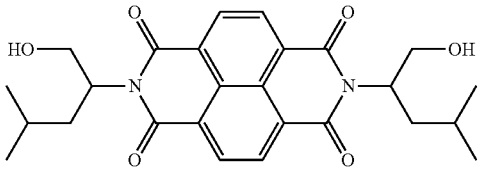

(10)

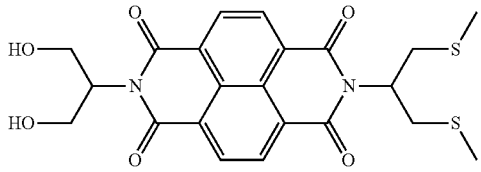

TABLE 2

| | Electron transport material | | Crosslinking agent | | Resin | | | | | | | | |
|---|---|---|---|---|---|---|---|---|---|---|---|---|---|
| | Compositional | | Compositional | | Compositional | | Initial | After 2000 sheets | | | After 8000 sheets | | |
| Example | Type | ratio | Type | ratio | Type | ratio | Ghost | Vd | Vl | Ghost | Vd | Vl | Ghost |
| 1 | 1-1 | 100 | Crosslinking agent 1 | 150 | Resin 1 | 3.75 | 0.020 | −699 | −201 | 0.022 | −696 | −204 | 0.029 |
| 2 | 1-2 | 100 | Crosslinking agent 1 | 150 | Resin 1 | 3.75 | 0.026 | −700 | −202 | 0.029 | −699 | −203 | 0.031 |
| 3 | 1-3 | 100 | Crosslinking agent 1 | 150 | Resin 1 | 3.75 | 0.024 | −698 | −201 | 0.027 | −697 | −202 | 0.033 |
| 4 | 1-5 | 100 | Crosslinking agent 1 | 150 | Resin 1 | 3.75 | 0.024 | −700 | −201 | 0.029 | −699 | −201 | 0.035 |
| 5 | 1-6 | 100 | Crosslinking agent 3 | 150 | Resin 2 | 3.75 | 0.023 | −697 | −200 | 0.028 | −696 | −202 | 0.035 |
| 6 | 1-8 | 100 | Crosslinking agent 3 | 150 | Resin 2 | 3.75 | 0.025 | −697 | −200 | 0.029 | −696 | −204 | 0.035 |
| 7 | 1-10 | 100 | Crosslinking agent 3 | 150 | Resin 3 | 3.75 | 0.026 | −700 | −202 | 0.029 | −697 | −203 | 0.034 |
| 8 | 1-11 | 100 | Crosslinking agent 2 | 150 | Resin 2 | 3.75 | 0.027 | −699 | −199 | 0.027 | −693 | −207 | 0.058 |
| 9 | 1-12 | 100 | Crosslinking agent 2 | 150 | Resin 2 | 3.75 | 0.027 | −702 | −203 | 0.028 | −692 | −206 | 0.060 |
| 10 | 1-13 | 100 | Crosslinking agent 3 | 150 | Resin 2 | 3.75 | 0.028 | −698 | −198 | 0.030 | −693 | −206 | 0.059 |
| 11 | 1-14 | 100 | Crosslinking agent 1 | 150 | Resin 1 | 3.75 | 0.025 | −701 | −202 | 0.029 | −698 | −203 | 0.036 |
| 12 | 1-17 | 100 | Crosslinking agent 1 | 150 | Resin 1 | 3.75 | 0.024 | −700 | −199 | 0.028 | −699 | −203 | 0.036 |
| 13 | 1-18 | 100 | Crosslinking agent 1 | 150 | Resin 1 | 3.75 | 0.026 | −700 | −198 | 0.029 | −696 | −202 | 0.035 |
| 14 | 1-19 | 100 | Crosslinking agent 1 | 150 | Resin 2 | 3.75 | 0.026 | −699 | −204 | 0.029 | −690 | −208 | 0.055 |
| 15 | 1-22 | 100 | Crosslinking agent 1 | 150 | Resin 2 | 3.75 | 0.021 | −702 | −202 | 0.025 | −700 | −204 | 0.030 |
| 16 | 1-23 | 100 | Crosslinking agent 1 | 150 | Resin 2 | 3.75 | 0.022 | −700 | −199 | 0.028 | −697 | −200 | 0.031 |
| 17 | 1-29 | 100 | Crosslinking agent 1 | 150 | Resin 2 | 3.75 | 0.023 | −698 | −203 | 0.028 | −693 | −206 | 0.053 |
| 18 | 1-1 | 100 | Crosslinking agent 1 | 212 | Resin 1 | 38 | 0.025 | −696 | −201 | 0.030 | −696 | −203 | 0.038 |
| 19 | 1-1 | 100 | Crosslinking agent 1 | 30 | Resin 1 | 20 | 0.024 | −700 | −201 | 0.025 | −697 | −203 | 0.028 |
| 20 | 1-1 | 100 | Crosslinking agent 1 | 150 | — | — | 0.025 | −698 | −203 | 0.028 | −697 | −204 | 0.030 |
| 21 | 1-1/1-2 | 50/50 | Crosslinking agent 1 | 150 | Resin 1 | 3.75 | 0.025 | −699 | −202 | 0.028 | −698 | −203 | 0.032 |
| 22 | 1-1/1-5 | 50/50 | Crosslinking agent 3 | 150 | Resin 1 | 3.75 | 0.023 | −697 | −202 | 0.027 | −697 | −203 | 0.035 |
| 23 | 1-1 | 100 | Crosslinking agent 1/ Crosslinking agent 3 | 50/100 | Resin 1 | 3.75 | 0.026 | −698 | −201 | 0.029 | −698 | −202 | 0.033 |

TABLE 3

| Comparative Example | Electron transport material Type | Compositional ratio | Crosslinking agent Type | Compositional ratio | Resin Type | Compositional ratio | Initial Ghost | After 2000 sheets Vd | After 2000 sheets Vl | After 2000 sheets Ghost | After 8000 sheets Vd | After 8000 sheets Vl | After 8000 sheets Ghost |
|---|---|---|---|---|---|---|---|---|---|---|---|---|---|
| 1 | Compound (7) | 100 | — | — | Polyamide resin | 100 | 0.037 | −691 | −210 | 0.060 | −678 | −229 | 0.081 |
| 2 | Compound (8) | 100 | — | — | Phenolic resin | 50 | 0.042 | −690 | −211 | 0.059 | −676 | −230 | 0.083 |
| 3 | Compound (9) | 100 | Crosslinking agent 1 | 230 | Resin 1 | 30 | 0.028 | −695 | −207 | 0.041 | −686 | −218 | 0.074 |
| 4 | Compound (10) | 100 | Crosslinking agent 1 | 195 | Resin 1 | 13.5 | 0.030 | −694 | −209 | 0.045 | −684 | −216 | 0.077 |

In Table 2, crosslinking agent 1 is an isocyanate type crosslinking agent (trade name: Desmodur BL3175, manufactured by Sumika Bayer Urethane Co., Ltd. (solid content: 60%)), crosslinking agent 2 is an isocyanate type crosslinking agent (trade name: Desmodur BL3575, manufactured by Sumika Bayer Urethane Co., Ltd. (solid content: 60%)), crosslinking agent 3 is a butylated melamine type crosslinking agent (trade name: SUPER BECKAMINE J821-60, manufactured by DIC Corporation (solid content: 60%)), and crosslinking agent 4 is a butylated urea type crosslinking agent (trade name: BECKAMINE P138, manufactured by DIC Corporation (solid content: 60%).

In Table 2, resin 1 (resin having a polymerizable functional group) is a polyvinyl acetal resin having a molar number of a hydroxy group per gram of 3.3 mmol and a molecular weight of $1\times10^5$, resin 2 is a polyvinyl acetal resin having a molar number of a hydroxy group per gram of 3.3 mmol and a molecular weight of $2\times10^4$, and resin 3 is a polyvinyl acetal resin having a molar number of a hydroxy group per gram of 2.5 mmol and a molecular weight of $3.4\times10^5$.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-127981, filed Jun. 25, 2015, which is hereby incorporated by reference herein in its entirety.

What is claimed is:

1. An electrophotographic photosensitive member comprising a support and an undercoat layer formed on the support, wherein the undercoat layer comprises a polymerization product of a composition comprising a compound that has a structure represented by formula (1) and that has a polarizability per unit volume according to a density functional approach (B3LYP/6-31+G**), of 0.533 to 0.594:

(1)

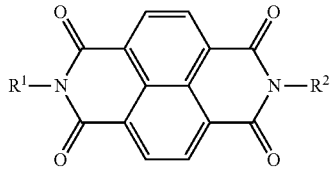

where $R^1$ and $R^2$ each independently represent a substituted or unsubstituted alkyl group, a group derived by replacing at least one $CH_2$ in a main chain of a substituted or unsubstituted alkyl group with an oxygen atom, a group derived by replacing at least one $CH_2$ in a main chain of a substituted or unsubstituted alkyl group with $NR^3$, a group derived by replacing at least one $C_2H_4$ in a main chain of a substituted or unsubstituted alkyl group with COO, or a substituted or unsubstituted aryl group; $R^3$ represents a hydrogen atom or an alkyl group, with the proviso that $R^1$ or $R^2$ represents two or more functional groups selected from the group consisting of hydroxy group and carboxyl group, and $R^1$ and $R^2$ in combination have at least two hydroxyl groups.

2. The electrophotographic photosensitive member according to claim 1, wherein the polarizability per unit volume according to a density functional approach (B3LYP/6-31+G**) is 0.545 to 0.577.

3. The electrophotographic photosensitive member according to claim 1, wherein $R^1$ represents a substituted alkyl group and the substituent corresponds to two or more hydroxy groups or carboxyl groups.

4. The electrophotographic photosensitive member according to claim 1, wherein the composition comprises at least one crosslinking agent selected from the group consisting of an isocyanate compound having an isocyanate group or a block isocyanate group and an amine compound having an N-methylol group or an alkyl-etherified N-methylol group.

5. The electrophotographic photosensitive member according to claim 1, wherein the composition further comprises a resin containing at least one polymerizable functional group selected from the group consisting of a hydroxy group, a thiol group, an amino group, a carboxyl group and a methoxy group.

6. The electrophotographic photosensitive member according to claim 4, wherein a mass ratio of the compound represented by the formula (1) to the crosslinking agent and/or the resin having a polymerizable functional group is 100:50 to 100:250.

7. A process cartridge that integrally supports an electrophotographic photosensitive member, and at least one unit selected from the group consisting of a charging unit, a developing unit, a transfer unit and a cleaning unit, and that is detachable from a main body of an electrophotographic apparatus, wherein the electrophotographic photosensitive member comprises a support and an undercoat layer formed on the support, and the undercoat layer comprises a polymerization product of a composition comprising a compound that has a structure represented by formula (1) and that has a polarizability per unit volume according to a density functional approach (B3LYP/6-31+G**), of 0.533 to 0.594:

(1)

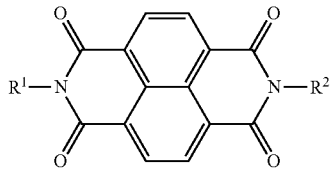

where $R^1$ and $R^2$ each independently represent a substituted or unsubstituted alkyl group, a group derived by replacing at least one $CH_2$ in a main chain of a substituted or unsubstituted alkyl group with an oxygen atom, a group derived by replacing at least one $CH_2$ in a main chain of a substituted or unsubstituted alkyl group with $NR^3$, a group derived by replacing at least one $C_2H_4$ in a main chain of a substituted or unsubstituted alkyl group with COO, or a substituted or unsubstituted aryl group; $R^3$ represents a hydrogen atom or an alkyl group, with the proviso that $R^1$ or $R^2$ represents two or more functional groups selected from the group consisting of hydroxy group and carboxyl group, and $R^1$ and $R^2$ in combination have at least two hydroxyl groups.

8. An electrophotographic apparatus comprising an electrophotographic photosensitive member, a charging unit, an exposure unit, a developing unit and a transfer unit, wherein the electrophotographic photosensitive member comprises a support and an undercoat layer formed on the support, and the undercoat layer comprises a polymerization product of a composition comprising a compound that has a structure represented by formula (1) and that has a polarizability per unit volume according to a density functional approach (B3LYP/6-31+G**), of 0.533 to 0.594:

(1)

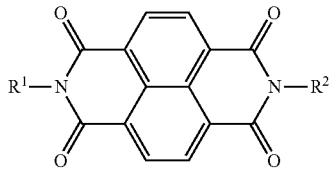

where $R^1$ and $R^2$ each independently represent a substituted or unsubstituted alkyl group, a group derived by replacing at least one $CH_2$ in a main chain of a substituted or unsubstituted alkyl group with an oxygen atom, a group derived by replacing at least one $CH_2$ in a main chain of a substituted or unsubstituted alkyl group with $NR^3$, a group derived by replacing at least one $C_2H_4$ in a main chain of a substituted or unsubstituted alkyl group with COO, or a substituted or unsubstituted aryl group; $R^3$ represents a hydrogen atom or an alkyl group, with the proviso that $R^1$ or $R^2$ represents two or more functional groups selected from the group consisting of hydroxy group and carboxyl group, and $R^1$ and $R^2$ in combination have at least two hydroxyl groups.

* * * * *